US005824238A

United States Patent [19]

Garcia et al.

[11] Patent Number: 5,824,238

[45] Date of Patent: Oct. 20, 1998

[54] ALCOHOL RESISTANT FILM-FORMING FLUOROPROTEIN FOAM CONCENTRATES

[75] Inventors: Gilbert Garcia, Eaubonne; Pierre Durual, Vernaison, both of France

[73] Assignee: Elf Atochem S.A., France

[21] Appl. No.: 686,598

[22] Filed: Jul. 26, 1996

[30] Foreign Application Priority Data

Jul. 27, 1995 [FR] France ..... 95 09139

[51] Int. Cl.[6] ..... A62D 1/00; A62D 1/04

[52] U.S. Cl. ..... 252/8.05; 252/2; 252/3

[58] Field of Search ..... 252/2, 3, 8, 8.05; 169/46, 47

[56] References Cited

U.S. PATENT DOCUMENTS

| | | | |
|---|---|---|---|
| 2,361,057 | 10/1944 | Ratzer | 252/3 |
| 3,475,333 | 10/1969 | Meldrum et al. | 252/3 |
| 4,149,599 | 4/1979 | Chiesa, Jr. | 169/47 |
| 4,424,133 | 1/1984 | Mulligan | 502/179 |
| 4,439,329 | 3/1984 | Kleiner et al. | 252/8.05 |
| 4,460,480 | 7/1984 | Kleiner et al. | 252/8.05 |
| 4,464,267 | 8/1984 | Chiesa, Jr. et al. | 252/8.05 |
| 4,717,744 | 1/1988 | Boutevin et al. | 524/17 |
| 5,391,721 | 2/1995 | Hanen et al. | 536/3 |
| 5,496,475 | 3/1996 | Jho et al. | 252/2 |

FOREIGN PATENT DOCUMENTS

| | | |
|---|---|---|
| 19 584 | 11/1984 | European Pat. Off. . |
| 524138 A1 | 1/1993 | European Pat. Off. . |
| 595772 A1 | 5/1994 | European Pat. Off. . |
| 609827 A1 | 8/1994 | European Pat. Off. . |
| 2206958 | 6/1974 | France . |
| 2575165 | 6/1986 | France . |
| 2636334 | 9/1988 | France . |
| 2637506 | 4/1990 | France . |
| 2230384 | 12/1994 | France . |
| 1280508 | 7/1972 | United Kingdom . |
| 1368463 | 9/1974 | United Kingdom . |
| WO 88/03425 | 5/1988 | WIPO . |
| WO 92/15371 | 9/1992 | WIPO . |

*Primary Examiner*—Joseph D. Anthony
*Attorney, Agent, or Firm*—Bell, Boyd & Lloyd

[57] ABSTRACT

The present invention relates to firefighting foam concentrates including a protein hydrolysate in association with:

(a) at least one fluorinated cotelomer which has a perfluoroalkyl radical and a polymerized chain consisting of units of an anionic hydrophilic monomer and of a nonionic hydrophilic monomer, and (b) at least one fluorinated surface-active agent whose aqueous solution at a concentration 1 g/l has at 20° C. a surface tension lower than 25 mN/m.

These film-forming emulsifiers are effective both against hydrocarbon fires and against polar-liquid fires.

18 Claims, No Drawings

ALCOHOL RESISTANT FILM-FORMING FLUOROPROTEIN FOAM CONCENTRATES

FIELD OF THE INVENTION

The present invention relates to the extinguishing of fires and its subject-matter is more particularly alcohol resistant multpurpose film-forming fluoroprotein firefighting foam concentrates, that is to say ones that can be employed both on hydrocarbon fires and on polar-liquid fires.

BACKGROUND OF THE INVENTION

Firefighting foam concentrates constitute an effective means for fighting against the fires of combustible liquids. When in use, they are diluted in mains water or seawater, generally in a concentration by volume of 3% (that is to say 3 volumes of foam concentrates per 97 volumes of water) or 6% (6 volumes of foam concentrate per 94 volumes of water). Since the quantity of active materials which is necessary to satisfy the minimum firefighting performance that is required is identical in both cases of dilution, the foam concentrates that can be diluted to 3% are therefore at least twice as concentrated as those that can be diluted to 6%; they enable the users to store smaller quantities of foam concentrates, to save space and to reduce their storage costs.

After water dilution of the foam concentrate the resulting mixture produces an aqueous foam by incorporation of air and input of mechanical energy by means of a firefighting nozzle or any other foam generator. This foam is poured over the fires of combustible liquids and functions by stifling and cooling until the extinction is complete.

Fluoroprotein foam concentrates have been developed for extinguishing hydrocarbon fires. In these foam concentrates the foaming base consists of a hydrolysate of animal proteins to which fluorinated surface-active agents and foam-stabilizing solvents are added. Such foam concentrates are described, for example, in patents GB 1 280 508, GB 1 368 463, U.S. Pat. No. 4,424,133, FR 2 230 384, WO 8803425 and U.S. Pat. No. 3,475,333.

Fluoroprotein foam concentrates such as those described above cannot be employed for extinguishing fires of polar liquids (alcohols, ketones, esters or ethers). For extinguishing this type of blaze a hydrophilic polymer of high molecular weight of the polysaccharide type of a thixotropic and alcohophobic nature is generally incorporated into the foam concentrates. An alcohol resistant foam concentrates is then obtained, that is to say one which can be employed both on hydrocarbon fires and on polar-liquid fires. The preparation and the use of such foam concentrates containing a polysaccharide as an alcohophobic agent are described in patents U.S. Pat. No. 4,149,599, U.S. Pat. No. 4,464,267, FR 2 206 958 and WO 9215371. When extinguishing polar-liquid fires, the polysaccharide present in the foam precipitates in contact with the polar liquid and forms a protective gelatinous sheet which insulates the foam against the destructive action of the polar liquid. The foam can then spread over the gelatinous sheet and extinguish the fire. On the other hand, however, since the polysaccharide in aqueous solution is a viscosity-increasing macromolecule, it considerably increases the final viscosity of the foam concentrate, which results in problems of pumpability in the injection and dilution systems, especially when cold.

Various means for reducing the viscosity of the foam concentrates have been developed. In particular, patent EP 595 772 describes the association of a polysaccharide with an anionic hydrophilic polymer enabling low-viscosity solutions to be prepared. Patent EP 609 827, which describes the combined use of a polysaccharide and of an alginate, indicates the means for reducing the viscosity of a an alcohol resistant emulsifier by controlling the relative proportions of the polysaccharide and of the alginate; the viscosity can also be reduced by controlling the ratio of the concentration of the aryl- or alkylarylsulphonic acid salts to the concentration of the other hydrocarbon surfactants. Patents FR 2 636 334 and FR 2 637 506 describe the chemical modification of the polysaccharides by grafting of perfluoroalkyl groups onto the hydrophilic side chains of the polysaccharide. The presence of perfluoroalkyl radicals increases the alcohophobic nature of the polysaccharide and improves its effectiveness in forming an insoluble gel at the surface of the polar solvent; this makes it possible to reduce the polysaccharide content and hence the final viscosity of the foam concentrate. However, this chemical grafting reaction requires heating to 50°–70° C. for two hours. Patent EP 524 138 relates to alcohol resistant foam concentrates using a polysaccharide in association with a fluorinated cotelomer. The fluorinated cotelomer is obtained by radical telomerization of a fluorinated telogen with a mixture of unfluorinated acrylic or methacrylic monomers. In this case, too, the use of the cotelomer in association with the polysaccharide reinforces its effectiveness and permits the incorporation of smaller quantities, and hence the formation of less viscous multipurpose foam concentrates. Although having a reduced viscosity, the foam concentrates described above nevertheless retain a pseudoplastic nature the viscosity of which varies with the rate of shear. In addition, the hydrolyzed protein-based foam concentrates often contain iron in the form of ferrous chloride or sulphate which, in some cases, present problems of compatibility with the polysaccharides and produce some deposit.

For the purpose of completely eliminating the presence of polysaccharide in alcohol resistant fluoroprotein foam concentrates, there are foam concentrates including the use of a hydrolysed protein in combination with a metal soap in solution in an aminoalcohol. These foam concentrates have the disadvantage of having to be employed very rapidly after dilution with water because they precipitate at the time of the dilution; besides, products of this type give rise to considerable sedimentation in storage.

The use of fluorinated telomers as oleophobic agents in fluoroprotein foam concentrates is known and described especially in patents EP 19584 and FR 2 575 165. These fluorinated telomers with a hydrophilic side chain improve the expansion of the foam, its mobility and its resistance to contamination by hydrocarbons; the same applies in U.S. Pat. No. 4,460,480, which describes the use of fluorinated cotelomers for the same application. However, the use of such foam concentrates for extinguishing polar-liquid fires is neither described nor suggested in these patents.

DESCRIPTION OF THE INVENTION

The present invention is aimed at gaining freedom from all the problems linked with the use of polysaccharides and at obtaining alcohol resistant film-forming fluoroprotein emulsifiers, that is to say ones that can be employed both on hydrocarbon fires and on polar-liquid fires and which have a rheological profile of the newtonian fluid type, that is to say that their viscosity is independent of the rate of shear, so as to facilitate their flow in injection and dilution systems at the time of their use.

It has now been found that this result can be achieved by using an unfluorinated protein-based foaming base in association with (a) at least one fluorinated cotelomer which has a perfluoroalkyl radical and a polymerized chain consisting of units of an anionic hydrophilic monomer and of a nonionic hydrophilic monomer and (b) at least one fluorinated surface-active agent whose aqueous solution at a concentration of 1 g/l has a surface tension lower than 25 mN/m. The foam concentrates thus formed are effective both against hydrocarbon fires and against polar-liquid fires. Since they do not contain any thixotropic hydrophilic polymer of high molecular weight of the polysaccharide type, they are completely fluid even at low temperature.

The subject-matter of the invention is therefore a film-forming fluoroprotein firefighting foam concentrate characterized in that it includes a protein hydrolysate used in combination with:

(a) at least one fluorinated cotelomer corresponding to the following formula:

$$Rf—(CH_2)_k—X_m—(CH_2)_n—S_p—(M^1)_{q^1}(M^2)_{q^2}—Y \quad (1)$$

in which:

Rf denotes a perfluoroalkyl radical with a linear or branched chain containing at least 6 carbon atoms, preferably from 6 to 20 carbon atoms, k is an integer ranging from 0 to 6, but other than 0 if m is equal to 1, X denotes an oxygen atom or a $CO_2$ or OCO group, m is equal to 0 or 1, n is an integer ranging from 0 to 6, but other than 0 if m and/or p is equal to 1, p is equal to 0 or 1, $M^1$ denotes an anionic hydrophilic monomer unit and $M^2$ a nonionic hydrophilic monomer unit, $q^1$ and $q^2$ are numbers whose sum is between 5 and 100, the ratio $q^2/q^1$ being between 1 and 20, preferably between 1 and 10, Y denotes a hydrogen atom when p is equal to 1 and an iodine, bromine or chlorine atom when p is equal to 0; and (b) at least one fluorinated surface-active agent whose aqueous solution at a concentration of 1 g/l has a surface tension at 20° C. which is lower than 25 mN/m, preferably lower than 20 mN/m and, more particularly, lower than 17 mN/m.

The protein hydrolysates, which are composed essentially of water and of soluble oligomers of hydrolyzed proteins and whose solids content is usually approximately 20 to 50% by weight, are well-known products (see, for example, patents U.S. Pat. No. 2,361,057 and U.S. Pat. No. 4,424,133). They are generally obtained by hydrolysis of animal proteins such as, for example, the keratin present in the hooves, the hair, the feathers and the horns, or the albumin present in the blood of animals. These organic materials are treated, with heating, optionally under pressure, with an alkaline solution (sodium hydroxide or lime) and the liquid resulting from the hydrolysis is neutralized to a pH of between 5 and 9 (preferably between 6 and 8), filtered and concentrated. Before storage a fermentation inhibitor such as formol and various inorganic additives such as iron, zinc, calcium or magnesium salts are generally added thereto.

The protein hydrolysate serves as a diluent medium for constituents (a) and (b) of the foam concentrate according to the invention. In the latter the weight content of fluorinated cotelomer(s) is advantageously between 0.2 and 5%, preferably between 0.5 and 2%. That of fluorinated surface-active agent(s) may range from 0.5 to 10% and is preferably between 1 and 5%.

Among the cotelomers according to the invention preference is given to those in which k is equal to 0 or 2, X denotes the OCO group, n is equal to 0 or 1, the sum $q^1+q^2$ is between 10 and 50, Y is a hydrogen or iodine atom, $M^1$ is a unit of formula:

$$—CH_2—\underset{\underset{COOQ^1}{|}}{CR}— \quad (II)$$

and $M^2$ a unit of formula:

$$—CH_2—\underset{\underset{Q^2}{|}}{CR'}— \quad (III)$$

in which each of R and R', which are identical or different, denotes a hydrogen atom or a methyl radical, $Q^1$ denotes a hydrogen atom, an alkali metal ion or a quaternary ammonium ion and $Q^2$ denotes an OH group or a $CONR^1R^2$ group in which each of the symbols $R^1$ and $R^2$, which are identical or different, denotes a hydrogen atom or an alkyl or hydroxyalkyl radical containing from 1 to 3 carbon atoms.

In the fluorinated cotelomers to be employed according to the invention the distribution of the $M^1$ and $M^2$ units may be random. The formula (I) is therefore merely a diagrammatic representation of the cotelomers and does not claim to describe the precise arrangement of the $M^1$ and $M^2$ units in the molecule. The fluorinated cotelomers according to the invention can be prepared in a manner which is known per se by reacting a fluorinated telogen agent of general formula:

$$Rf—(CH_2)_k—X_m—(CH_2)_n—S_p—Y \quad (IV)$$

with the monomers producing the units $M^1$ and $M^2$ in the presence of a radical initiator. The operation may be carried out in various ways, for example:

by mixing all the reactants (initiator, telogen, monomers $M^1$ and $M^2$);

by simultaneously pouring onto the fluorinated telogen present in the reactor, on the one hand, the mixture of the monomers $M^1$ and $M^2$ and, on the other hand, a solution of the radical initiator;

by simultaneously pouring, on the one hand, the fluorinated telogen containing the initiator and, on the other hand, the mixture of the monomers $M^1$ and $M^2$.

It is desirable to operate in solution in a solvent chosen from alcohols (preferably methanol, ethanol, isopropanol or tert-butanol) and glycol ethers, in particular glymes (preferably mono- and diglyme).

The radical initiator may be an azo-type initiator such as, for example, azobisisobutyronitrile or 4,4'-azobiscyanopentanoic acid, or of peroxide type such as, for example, dicyclohexyl peroxydicarbonate, benzoyl peroxide or di-tert-butyl peroxide. The initiator may be used in solution and in this case the solvent of the reaction or else methylene chloride or N-methylpyrrolidone may be employed. The initiator concentration may vary from 0.5 to 25% by weight relative to the telogen, according to the relative reactivity of the telogen and of the monomers $M^1$ and $M^2$. The reaction temperature is between 0°and 150° C., preferably between 60°and 90° C.

As telogen agents of formula (IV) which are particularly advantageous in the context of the present invention the following may be mentioned, Rf having the same meaning as in formula (I):

perfluoroalkyl iodides: Rf—I producing the cotelomers (I) in which k=m=n=p=0;

2-(perfluoroalkyl)ethyl iodides: $Rf—CH_2CH_2—I$ producing the cotelomers (I) in which k=2 and m=n=p=0;

2-(perfluoroalkyl)ethyl mercaptans: $Rf—CH_2CH_2—SH$ producing the cotelomers (I) in which k=2, m=n=0 and p=1;

thioglycolates of fluorinated alcohols: $Rf—CH_2CH_2—OCO-CH_2SH$ producing the cotelomers (I) in which k=2 and m=n=p=1.

The following may be mentioned, no limitation being implied, as examples of anionic hydrophilic monomer of unit $M^1$:

acrylic acid, methacrylic acid and their alkali metal or quaternary ammonium ion salts;

monoolefinic derivatives of sulphonic acid and their alkali metal salts such as, for example, sodium ethylenesulphonate, sodium styrenesulphonate and 2-acrylamido-2-methylpropanesulphonic acid.

Among the compounds mentioned above for the choice of the monomer $M^1$ preference is given to acrylic acid and its alkali metal salts.

The following may be mentioned, no limitation being implied, as examples of nonionic hydrophilic monomer of unit $M^2$:

acrylamide and its derivatives such as N-methylacrylamide, N-ethylacrylamide, N,N-dimethyl-acrylamide, N-methyl-N-ethylacrylamide, N-hydroxy-methylacrylamide, N-(2-hydroxyethyl) acrylamide and N-(3-hydroxypropyl)acrylamide;

N-vinyl derivatives such as N-vinyl-acetamide, N-vinyl-2-pyrrolidone, N-vinyl-3-methyl-2-pyrrolidone, N-vinyl-4-methyl-2-pyrrolidone and N-vinyl-5-methyl-2-pyrrolidone;

acrylates or methacrylates of aminoalcohols of general formula:

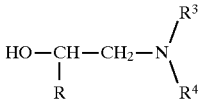

(V)

in which R has the same meaning as above, each of the symbols $R^3$ and $R^4$, which are identical or different, denotes a hydrogen atom or a linear or branched alkyl radical containing 1 to 4 carbon atoms or else $R^3$ and $R^4$ together with the nitrogen atom form a piperidino or 1-pyrrolidinyl radical, such as, for example, N,N-dimethylamino-2-ethanol, N,N-diethylamino-2-ethanol, N-ethyl-N-methylamino-2-ethanol, piperidino-2-ethanol, (1-pyrrolidinyl)-2-ethanol and 1-methylamino-2-propanol;

acrylates or methacrylates of polyethoxylated alcohols of general formula:

$$HO—R^5—(OCH_2CH_2)_r—OR^6 \quad (VI)$$

in which $R^5$ denotes an alkylene group containing 2 to 5 carbon atoms, r is an integer between 1 and 10 and $R^6$ denotes a hydrogen atom or a methyl or ethyl group;

vinyl acetate by following the telomerization with hydrolysis to obtain polyvinyl alcohol units.

Among the compounds mentioned above for the choice of the monomer $M^2$ preference is given to acrylamide or vinyl acetate.

The preparation of the cotelomers can also take place in two stages including a stage of telomerization of a single nonionic hydrophilic monomer of the $M^2$ type, followed by a partial hydrolysis converting a fraction of the $M^2$ units into units of anionic hydrophilic monomer of the $M^1$ type. Thus, for example, it is possible to partially hydrolyse acrylamide derivatives or acrylates of aminoalcohols to acrylic acid; the cotelomer originating from the hydrolysis then has the two types of units $M^1$ and $M^2$ in the polymerized hydrophilic portion.

The surface-active agents to be employed according to the invention may be chosen, without any limitation being implied, from the compounds of formulae:

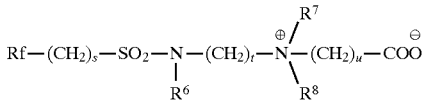

(VII)

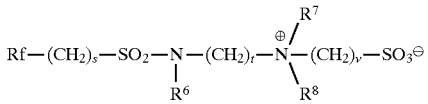

(VIII)

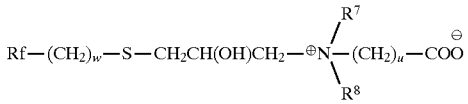

(IX)

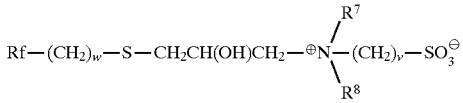

(X)

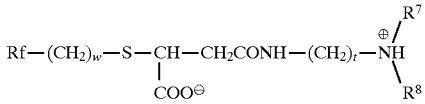

(XI)

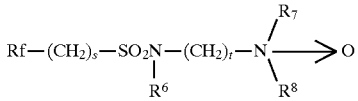

(XII)

$$Rf—(CH_2)_w—S—(CH_2)_t—CONH—C(CH_3)_2—CH_2SO_3Na \quad (XIII)$$

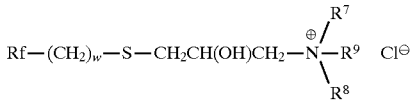

(XIV)

in which Rf denotes a linear or branched perfluoroalkyl radical containing at least 6 carbon atoms, s is an integer ranging from 0 to 6, $R^6$ denotes a hydrogen atom or a methyl or ethyl radical, t and u are integers ranging from 1 to 5, v is equal to 2 or 3, each of the symbols $R^7$, $R^8$ and $R^9$, which are identical or different, denotes a methyl or ethyl radical and w is an integer ranging from 1 to 6.

The compounds of the following formulae may be mentioned more particularly as nonlimiting examples of fluorinated surfactants (b) which can be employed within the scope of the invention:

$$C_6F_{13}—CH_2CH_2—SO_2NH—CH_2CH_2—N^{\oplus}(CH_3)_2—CH_2—COO^{\ominus}$$

$$C_6F_{13}—CH_2CH_2—SO_2NH—CH_2CH_2CH_2—N^{\oplus}(CH_3)_2—CH_2—COO^{\ominus}$$

-continued $$C_8F_{17}-SO_2NH-CH_2CH_2CH_2-N^{\oplus}(CH_3)_2-CH_2-COO^{\ominus}$$

$$C_6F_{13}-CH_2CH_2-SO_2NH-CH_2CH_2CH_2-N^{\oplus}(CH_3)_2-CH_2CH_2-COO^{\ominus}$$

$$C_6F_{13}-CH_2CH_2-SO_2NH-CH_2CH_2CH_2-N^{\oplus}(CH_3)_2-CH_2CH_2CH_2-SO_3^{\ominus}$$

$$C_6F_{13}-CH_2CH_2-SO_2N(CH_3)-CH_2CH_2CH_2-N^{\oplus}(CH_3)_2-CH_2CH_2CH_2-SO_3^{\ominus}$$

$$C_6F_{13}-CH_2CH_2-S-CH_2-CH(OH)-CH_2-N^{\oplus}(CH_3)_2-CH_2-COO^{\ominus}$$

$$C_6F_{13}-CH_2CH_2-SO_2NH-CH_2CH_2CH_2-N(CH_3)_2 \longrightarrow O$$

$$C_6F_{13}-CH_2CH_2-SO_2N(CH_3)-CH_2CH_2CH_2-N(CH_3)_2 \longrightarrow O$$

as well as the mixtures of betaines of formula:

$$C_xF_{2x+1}-CH_2CH_2-SO_2NH-CH_2CH_2CH_2-N^{\oplus}(CH_3)_2-CH_2-COO^{\ominus}$$

the mixtures of betaines of formula:

$$C_xF_{2x+1}-CH_2CH_2-S-CH_2-CH(OH)-CH_2N^{\oplus}(CH_3)_2-CH_2COO^{\ominus}$$

the mixtures of sulphobetaines of formula:

$$C_xF_{2x+1}-CH_2CH_2-SO_2N(CH_3)-(CH_2)_3-N^{\oplus}(CH_3)_2-CH_2CH_2CH_2-SO_{3\ominus}$$

the mixtures of amine oxides of formula:

$$C_xF_{2x+1}-CH_2CH_2-SO_2NH-CH_2CH_2CH_2-N(CH_3)_2 \rightarrow O$$

the mixtures of compounds of formula:

$$C_xF_{2x+1}-CH_2CH_2-S-\underset{\underset{COO^{\ominus}}{|}}{CH}-CH_2CONH-CH_2CH_2CH_2-NH^{\oplus}(CH_3)_2$$

the mixtures of compounds of formula:

$$C_xF_{2x+1}-CH_2CH_2-S-CH_2CH_2CONH-C(CH_3)_2-CH_2-SO_3Na$$

and the mixtures of compounds of formula:

$$C_xF_{2x+1}-CH_2CH_2-S-CH_2-CH(OH)-CH_2N^{\oplus}(CH_3)_3Cl^{\ominus}$$

in which formulae x is an even integer ranging from 6 to 20.

In addition to its essential constituents (protein hydrolysate, fluorinated cotelomer and fluorinated surface-active agent), the alcohol resistant foam concentrate according to the invention may optionally contain various additives such as:

- a foam-stabilizing, water-miscible organic solvent chosen from glycols and mono- or diethylene (or propylene) glycol monoalkyl ethers;
- an anticorrosion agent such as, for example, sodium nitrite;
- a preserving agent such as, for example, sodium benzoate, formaldehyde, ortho-phenylphenol or 5-methyl-1H-benzotriazole;
- an antifreeze such as, for example, ethylene glycol,
- a pH-stabilizer such as, for example, diethanolamine, triethanolamine or urea.

The preparation of the foam concentrates according to the invention may be carried out merely by addition of the constituents (a), (b) and of the optional additives into the protein hydrolysate. The operation may be performed at ambient temperature or with heating to a moderate temperature, with stirring. The fluoroprotein foam concentrate thus obtained may be diluted with mains water or seawater in a proportion of 0.5 to 6 parts by volume (preferably 1 to 3 parts by volume) per 100 parts by volume in total. The resulting extinguishing composition is employed for fighting hydrocarbon and polar-liquid fires.

The performance of the foam concentrate according to the invention can be evaluated by means of the following applicable tests:

Expansion

The expansion (or expansion ratio) is the ratio of the volume of foam produced from an aqueous solution containing 3% of foam concentrate to the initial liquid volume. To determine the expansion 100 ml of aqueous solution containing 3% of foam concentrate are introduced into a 1-liter test tube and then the solution is beaten for one-minute at a rate of one beat per second with the aid of a perforated circular plunger (30 holes of 5-mm diameter, representing 25% of the surface) and attached in its centre to a metal rod.

For an efficient foam concentrate the expansion must be at least equal to 6.

25% Drainage Time

After having carried out the above expansion test the time needed to collect by separation 25% of the initial liquid which has been used to form the foam is measured. The drainage time must be between 5 and 20 minutes.

Test for Spreading on Hydrocarbon

This test, which indicates the rate of formation of an aqueous film on the surface of hydrocarbons, is carried out by pouring 50 ml of hydrocarbon into a Petri dish (diameter: 11.8 cm) whose outer face is painted black in order to allow the film to be observed. When the surface of the hydrocarbon is motionless 0.5 ml of an aqueous solution containing 3% of foam concentrate emulsifier is deposited with the aid of a micropipette. The solution must be deposited dropwise starting in the middle and by performing an eccentric movement. The stopwatch is started at the instant of the deposition of the first drop and stopped when the film has covered the whole surface of the hydrocarbon. The time is noted. If total covering is not obtained in less than one minute, the percentage of surface covered after one minute is noted.

Test for Foam-Sealing on a Polar Liquid

An automatic balance connected to a recorder is arranged. 50 ml of a polar solvent (acetone) are poured into a crystallizing dish 9.8 cm in diameter placed on the balance pan. Separately, the foam concentrate is diluted to 3% in mains water or seawater and the foam is produced with the aid of an electrical beater for 2 minutes. Approximately 18 g of foam are deposited on the polar solvent. The balance is reset to zero and the loss in weight, due to evaporation, of the polar liquid is observed as a function of time. The results are expressed in mg/min.

The most effective foam concentrate for giving a foam which is leakproof to polar liquid vapors are those whose evaporation in mg/min is the lowest.

Tests are also carried out in more severe conditions on polar-liquid fires. In this case the procedure is identical but the polar liquid is ignited and allowed to burn for 90 seconds before the foam is poured on in order to extinguish it. The quantity of polar liquid employed is 150 ml and approximately 50 g of foam are poured.

The rate of evaporation of the acetone must be lower than 85 mg/min in the case of the cold test and lower than 150 mg/min in the case of the test on fire.

Synthetic Seawater Composition

| | |
|---|---|
| Anhydrous sodium chloride NaCl | 25.0 g |
| Magnesium chloride $MgCl_2.6H_2O$ | 11.0 g |
| Calcium chloride $CaCl_2.2H_2O$ | 1.6 g |
| Anhydrous sodium sulphate $Na_2SO_4$ | 4.0 g |
| Water q.s. | 1 liter |

EXAMPLES

The following examples illustrate the invention without limiting it. In these examples each of the symbols $Rf^1$, $Rf^2$, $Rf^3$, $Rf^4$, $Rf^5$ and $Rf^6$ denotes a mixture of linear perfluoroalkyl radicals. The relative proportions of the various perfluoroalkyl radicals in mass % in the mixtures denoted $Rf^1$, $Rf^2$, $Rf^3$, $Rf^4$, $Rf^5$ and $Rf^6$ are shown in the following table:

| | $Rf^1$ | $Rf^2$ | $Rf^3$ | $Rf^4$ | $Rf^5$ | $Rf^6$ |
|---|---|---|---|---|---|---|
| $C_6F_{13}$ | 46.5 | 49.0 | 70.0 | 0.4 | — | — |
| $C_8F_{17}$ | 34.0 | 36.2 | 23.0 | 64.3 | 64.1 | 4.1 |
| $C_{10}F_{21}$ | 12.0 | 12.0 | 5.0 | 26.8 | 27.4 | 75.3 |
| $C_{12}F_{25}$ | 3.9 | 2.8 | 1.5 | 6.5 | 7.0 | 15.1 |
| $C_{14}F_{29}$ | 3.6 | — | 0.4 | 1.5 | 1.5 | 5.1 |
| $C_{16}F_{33}$ | — | — | 0.1 | 0.5 | — | 0.4 |

The solids contents were determined by keeping 10 to 20 g of solution placed in a crystallizing dish of 150-mm diameter for 5 hours in an oven at 120° C.

Example 1

55 g of tert-butanol, 1 g of azobisisobutyro-nitrile and 49 g (0.1 mol) of perfluoroalkyl iodide $Rf^1$-I are introduced into a one liter reactor fitted with a heating device, a stirrer, a thermometer, a nitrogen inlet and a reflux condenser. The temperature is raised to 80° C. in 30 minutes, while a nitrogen stream is maintained. The following two mixtures are then run in simultaneously over 3 h 30 min:

mixture A:

85.2 g (1.2 mol) of acrylamide
57.6 g (0.8 mol) of acrylic acid
330 g of tert-butanol mixture B:

10 g of azobisisobutyronitrile
50 g of N-methylpyrrolidone

The cotelomers precipitate after a few minutes. At the end of the introduction of the two mixtures A and B the mixture is still kept at 80° C. for 2 hours. 280 g of tert-butanol are then distilled off and 600 g of water are then added and 211 g of water/tert-butanol azeotrope are distilled off. Water is added until 1007 g are obtained of a solution (S1) with a solids content of 20% of the fluorinated cotelomers of formula:

$$Rf^1—\{CH_2—CH(COOH)\}_8—\{CH_2—CH(CONH_2)\}_{12}—I$$

8 g of solution S1, followed by 10 g of a hydroalcoholic solution containing 27% of the fluorinated betaine of formula:

$$C_6F_{13}—CH_2CH_2—SO_2NH—CH_2CH_2CH_2—N^{\oplus}(CH_3)_2—CH_2—COO^{\ominus}$$

are added at ambient temperature and with moderate stirring to 82 g of a protein hydrolysate with a solids content of 44%.

A fluoroprotein foam concentrate according to the invention is obtained. This foam concentrate is diluted to 3% with mains water and with synthetic seawater and the two resulting solutions have the characteristics reported in the following table when subjected to the tests described above.

| Characteristic | Dilution with mains water | Dilution with synthetic seawater |
|---|---|---|
| Expansion | 8.5 | 9.0 |
| 25% drainage time | 9 min 30 s | 9 min |
| Spreading on cyclohexane | 15 s | 16 s |
| Surface tension | 15.8 mN/m | 15.6 mN/m |
| Sealing on acetone (cold test) | 55 mg/min | 80 mg/min |
| Sealing on acetone (test on fire) | 102 mg/min | 113 mg/min |

Examples 2 to 7

By proceeding as in Example 1 a series of fluorinated cotelomers is prepared, the chemical structures of which are listed in the following table.

The quantities of tert-butanol, azobisisobutyronitrile and N-methylpyrrolidone per 0.1 mol of iodide Rf-I are kept constant and acrylic acid and acrylamide are employed in quantities corresponding to the structure shown.

| Example | Structure of the fluorinated cotelomers |
|---|---|
| 2 | $Rf^1—[CH_2—CH(COOH)]_4—[CH_2—CH(CONH_2)]_{16}—I$ |
| 3 | $Rf^1—[CH_2—CH(COOH)]_5—[CH_2—CH(CONH_2)]_7—I$ |
| 4 | $Rf^4—[CH_2—CH(COOH)]_2—[CH_2—CH(CONH_2)]_{18}—I$ |
| 5 | $Rf^4—[CH_2—CH(COOH)]_3—[CH_2—CH(CONH_2)]_{17}—I$ |
| 6 | $Rf^4—[CH_2—CH(COOH)]_4—[CH_2—CH(CONH_2)]_{16}—I$ |
| 7 | $Rf^6—[CH_2—CH(COOH)]_4—[CH_2—CH(CONH_2)]_{16}—I$ |

In the case of each cotelomer (where Sx is the water/tert-butanol solution containing 20% of the fluorinated cotelomer of Example x) a fluoroprotein foam concentrate is prepared by proceeding as in Example 1 but replacing the solution S1 with the solution Sx. The fluoroprotein foam concentrates thus prepared are diluted to 3% with mains water and the resulting solutions exhibit the characteristics shown in the following table.

| Example | 2 | 3 | 4 | 5 | 6 | 7 |
|---|---|---|---|---|---|---|
| Expansion | 8.5 | 9.0 | 9.2 | 8.5 | 8.5 | 9.2 |
| Spreading on | 17 | 13 | 21 | 21 | 23 | 48 |

-continued

| Example | 2 | 3 | 4 | 5 | 6 | 7 |
|---|---|---|---|---|---|---|
| cyclohexane(s) Sealing on acetone, cold test (mg/min) | 54 | 70 | 70 | 79 | 59 | 63 |

Example 8

55 g of tert-butanol and 0.03 g of 4,4'-azobiscyanopentanoic acid are introduced into a one-liter reactor fitted with a heating device, a stirrer, a thermometer, a nitrogen inlet and a reflux condenser. The temperature is raised to 80° C. over 30 minutes while a nitrogen stream is maintained. The following two mixtures are then run in simultaneously over 3 h 30 min:

mixture A:

38 g (0.1 mol) of 2-(perfluorohexyl)-ethanethiol ($C_6F_{13}$—$C_2H_4SH$)

50 g of tert-butanol 0.24 g of 4,4'-azobiscyanopentanoic acid mixture B:

113.6 g (1.6 mol) of acrylamide 28.8 g (0.4 mol) of acrylic acid 330 g of tert-butanol At the end of the introduction of the two mixtures A and B 0.03 g of 4,4'-azobiscyanopentanoic acid is added and the temperature is then maintained at 80° C. for 2 hours. 256 g of tert-butanol are distilled off and then 500 g of water are added and 202 g of the water/tert-butanol azeotrope are distilled off. 680 g are obtained of a solution with a solids content of 22%, which is adjusted by adding water to obtain a solution (S8) containing 20% of the fluorinated cotelomer of formula:

$$C_6F_{13}—C_2H_4S\{CH_2—CH(COOH)\}_4—\{CH_2—CH(CONH_2)\}_{16}—H$$

4 g of solution S8 followed by 5 g of a hydroalcoholic solution containing 27% of the fluorinated betaine formula:

$$C_6F_{13}—CH_2CH_2—S—CH_2—CH(OH)—CH_2—N^+(CH_3)_2—CH_2—COO^{\ominus}$$

are added at ambient temperature and with moderate stirring to 91 g of a protein hydrolysate with a solids content of 35%.

A fluoroprotein foam concentrate according to the invention is obtained. This foam concentrate emulsifier is diluted to 6% with mains water and the resulting solution exhibits the following characteristics when subjected to the tests described above:

Expansion:9.7

25% drainage time:9 min 30 s

Spreading on cyclohexane:14 seconds

Sealing on acetone (cold test):46 mg/min

Example 9

The procedure is as in Example 8 but the 38 g of 2-(perfluorohexyl)ethanediol are replaced with 52 g of 2-(perfluoroalkyl)ethanethiols of general formula:

$$Rf^5—C_2H_4—SH$$

765 g are obtained of a solution with a solids content of 25.3%, containing 10% of tert-butanol which is evaporated off in the oven. An adjustment is made, by adding water, to obtain a solution (S9) containing 20% of the fluorinated cotelomers of formula:

$$Rf^5—C_2H_4—S—\{CH_2—CH(COOH)\}_4—\{CH_2—CH(CONH_2)\}_{16}—H$$

4 g of solution S9 followed by 5 g of a hydroalcoholic solution containing 27% of the fluorinated betaine of formula:

$$C_6F_{13}—CH_2CH_2—SO_2NH—CH_2CH_2CH_2—N^{61}(CH_3)_2—CH_2COO^{\ominus}$$

are added at ambient temperature and with moderate stirring to 91 g of a protein hydrolysate with a solids content of 37%.

A fluoroprotein foam concentrate according to the invention is obtained. This emulsifier is diluted to 6% with mains water and the resulting solution exhibits the following characteristics when subjected to the tests described above:

Expansion: 8.2

25% drainage time: 10 min

Spreading on cyclohexane: 50%

Sealing on acetone (cold test): 53 mg/min

Example 10

55 g of tert-butanol and 0.03 g of 4,4'-azobiscyanopentanoic acid are introduced into a one-liter reactor fitted with a heating device, a stirrer, a thermometer, a nitrogen inlet and a reflux condenser. The temperature is raised to 80° C. over 30 minutes while a nitrogen stream is maintained. The following two mixtures are then run in simultaneously over 3 h 30 min:

mixture A:

50 g of tert-butanol 1 g of 4,4'-azobiscyanopentanoic acid 51.6 g (0.1 mol) of thioglycolates of 2-(perfluoroalkyl)ethanol, of formula:

$$Rf^2—C_2H_4OCOCH_2SH$$

mixture B:

113.6 g (1.6 mol) of acrylamide 28.8 g (0.4 mol) of acrylic acid 330 g of tert-butanol 0.5 g of 4,4'-azobiscyanopentanoic acid is added 30 minutes after the beginning of running-in of the mixtures A and B. 0.2 g of 4,4'-azobiscyano-pentanoic acid is added at the end of the introduction of the two mixtures A and B and the temperature is then still kept at 80° C. for 2 hours. 256 g of tert-butanol are then distilled off and then 500 g of water are added and 202 g of the water/tert-butanol azeotrope are distilled off. 724 g are obtained of a solution with a solids content of 26%, which is adjusted by adding water to obtain a solution (S10) containing 20% of the fluorinated cotelomers of formula:

$$Rf^2—C_2H_4OCOCH_2S\{CH_2—CH(COOH)\}_4—\{CH_2—CH(CONH_2)\}_{16}—H$$

4 g of solution S10 followed by 4 g of a hydroalcoholic solution containing 40% of the amine oxide of formula:

$$C_6F_{13}—CH_2CH_2—SO_2NH—CH_2CH_2CH_2—N(CH_3)_2\rightarrow O$$

are added at ambient temperature and with moderate stirring to 92 g of a protein hydrolysate with a solids content of 35%.

A fluoroprotein foam concentrate according to the invention is obtained, which is diluted to 6% with mains water.

The resulting solution exhibits the following characteristics when subjected to the tests described above:

Expansion: 8.8

25% drainage time: 17 min

Spreading on cyclohexane: 25%

Sealing on acetone (cold test): 47 mg/min

Example 11

98 g of tert-butanol, 1.8 g of azobisisobutyronitrile and 119 g (0.18 mol) of perfluoroalkyl iodide $Rf^6$—I are introduced into a one-liter reactor fitted with a heating device, a stirrer, a thermometer, a nitrogen inlet and a reflux condenser. The temperature is raised to 85° C. over 30 minutes while a nitrogen stream is maintained. The following two mixtures are then run in simultaneously over 3 h 30 min:

mixture A:

256 g (3.6 mol) of acrylamide 594 g of tert-butanol mixture B:

18 g of azobisisobutyronitrile 90 g of N-methylpyrrolidone

At the end of the introduction of the two mixtures A and B the mixture is still kept at 85° C. for 2 hours. 449 g of tert-butanol are then distilled off and then 500 g of water are added. The solution obtained is evaporated down in the oven and then water is added until 2026 g of a solution are obtained with a solids content of 20% of the fluorinated telomers of formula:

$$Rf^6—\{CH_2—CH(CONH_2)\}_{20}—I$$

112.5 g of the solution obtained above are mixed with a solution of 1.6 g of sodium hydroxide in 4 g of water and the mixture is then heated to 70° C. for 2 hours. Infrared analysis of the resulting product shows a band which is characteristic of the COO carboxylate group at 1565 $cm^{-1}$. A new solution is obtained, which is adjusted to obtain a solution (S11) with a solids content of 20% of the fluorinated cotelomers of formula:

$$Rf^6—\{CH_2—CH(CONH_2)\}_{16}—\{CH_2CH(COONa)\}_4—I$$

8 g of solution S11 followed by 10 g of a hydroalcoholic solution containing 27% of a mixture of fluorinated betaines of formula:

$$Rf^3—CH_2CH_2—SO_2NH—CH_2CH_2CH_2—N^{\oplus}(CH)_2—CH_2—COO^{\ominus}$$

are added at ambient temperature and with moderate stirring to 82 g of a protein hydrolysate with a solids content of 44%.

A fluoroprotein foam concentrate according to the invention is obtained. This foam concentrate emulsifier is diluted to 3% with mains water and the resulting solution exhibits the follow characteristics when subjected to the tests described above:

Expansion: 8.2

25% drainage time: 11 min

Spreading on cyclohexane: 25%

Sealing on acetone (cold test): 59 mg/min

Example 12

80 g of methanol, 30 g of vinyl acetate, 11 g of acrylic acid and 12 g of 2-(perfluorooctyl)ethanethiol $C_8F_{17}—C_2H_4—SH$ are mixed at ambient temperature.

One third of this mixture is introduced into a 500-ml reactor fitted with a stirrer, a thermometer, a reflux condenser, a dropping funnel, a nitrogen inlet and a heating device. The remainder of the mixture is introduced into the dropping funnel. 0.2 g of azobisisobutyronitrile is added to the reactor. A stream of nitrogen is introduced into the reactor and is maintained throughout the reaction period. The mixture is stirred and heated to reflux at 70° C. 30 minutes after the reflux begins, the content of the dropping funnel is run in over 4 hours. 0.2 g of azobisisobutyronitrile is then introduced into the reaction mixture. Refluxing is continued for 4 hours longer and a fluorinated cotelomer (synthesis intermediate) of formula:

$$C_8F_{17}—C_2H_4—S—\{CH_2—CH(COOH)\}_6—\{CH_2CH(OCOCH_3)\}_{14}—H$$

is obtained in the reactor, in methanolic solution.

The content of the reactor is heated to 50° C. 1 g of sodium and 16 g of methanol are introduced into the dropping funnel; the mixing of the two materials results in the formation of sodium methanolate in solution in methanol, with a release of hydrogen. The sodium methanolate solution is added dropwise to the reactor while the temperature of the reactor is maintained at 50° C. The product originating from the hydrolysis precipitates gradually in the reaction mixture. After all the sodium methanolate solution has been added the temperature is kept at 50° C. for 30 minutes and the mixture is then cooled to ambient temperature. The precipitate present in the reactor is recovered by filtration on a No. 3 sinter and is washed with 80 ml methanol and then recovered by evaporation of the methanol in a rotary evaporator and drying in the oven at 50° C. for 12 hours. 23 g of a water-soluble white powder are obtained, the structure of which is the following:

$$C_8F_{17}—C_2H_4—S—\{CH_2—CH(COOH)\}_6—\{CH_2CH(OH)\}_{14}—H$$

The procedure is then as in Example 11, but the 8 g of solution S11 are replaced with an equivalent quantity of an aqueous solution containing 20% of the fluorinated cotelomer prepared above. A fluoroprotein foam concentrate emulsifier according to the invention is obtained. This foam concentrate emulsifier is diluted to 3% with mains water and the resulting solution exhibits the following characteristics when subjected to the tests described above:

Expansion: 8.2

25% drainage time: 10 min

Spreading on cyclohexane: 25%

Sealing on acetone (cold test): 51 mg/min

Example 13 (Comparative)

The procedure is as in Example 1, but the 8 g of solution S1 are replaced with an equivalent quantity of water. A fluoroprotein emulsifier not in accordance with the invention is obtained. This emulsifier is diluted to 3% with mains water and the resulting solution is subjected to the sealing tests on acetone. The results are the following:

Sealing on acetone (cold test): 125 mg/min

Sealing on acetone (test on fire): 168 mg/min

The absence of the fluorinated cotelomer (a) does not make it possible to obtain an extinguishing foam which is sufficiently stable on a polar solvent and results in a rate of evaporation of acetone which is much too high both in the cold test and on an acetone fire.

Example 14 (Comparative)

The procedure is as in Example 1 but the 10 g of the fluorinated betaine solution are replaced with an equivalent quantity of water. A fluoroprotein foam concentrate emulsifier not in accordance with the invention is obtained. This emulsifier gives the following results when diluted to 3% with mains water and subjected to the applicable tests:

Expansion: 7.0

Spreading on cyclohexane: no spreading

Surface tension: 30 mN/m

The absence of the fluorinated surfactant (b) does not make it possible to lower the surface tension of the mixture sufficiently to make it possible to demonstrate the property of film forming on hydrocarbon.

Example 15 (Comparative)

The procedure is as in Example 1 but the fluorinated cotelomer is replaced with the telomer of the following structure:

$$Rf^4—\{CH_2—CH(CONH_2)\}_{20}—I$$

The fluoroprotein foam concentrate emulsifier thus obtained, not in accordance with the invention, is diluted to 3% with mains water and the resulting solution exhibits the following characteristics when subjected to the tests for sealing on acetone:

Sealing on acetone (cold test): 105 mg/min

Sealing on acetone (test on fire): 288 mg/min

Examples 16 to 19

A series of extinguishing tests are carried out according to NF standard S 60225 —reference test on 0.25 $m^2$ acetone fire. The emulsifiers are diluted with mains water. The results of the extinguishing tests are reported in the following table:

| Example | Emulsifier | Dilution ratio (%) | Foam application time (seconds) | Extinguishing (seconds) 90% | 99% | Extinguishing | Reignition time (seconds) |
|---|---|---|---|---|---|---|---|
| 16 | Emulsifier of Example 2 | 3 | 120 | 60 | 75 | 95 | 330 |
| 17 | Emulsifier of Example 6 | 3 | 120 | 20 | 25 | 55 | 375 |
| 19 | Emulsifier of Example 9 | 6 | 120 | 10 | 15 | 45 | 795 |
| 19 (comparative) | Emulsifier of Example 13 | 3 | 240 | No extinguishing | | | |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

We claim:

1. Film-forming fluoroprotein firefighting foam concentrate comprising a protein hydrolysate used in combination with:

(a) at least one fluorinated cotelomer corresponding to the following formula:

$$Rf—(CH_2)_k—X_m—(CH_2)_n—S_p—(M^1)_q{}^1(M^2)_q{}^2—Y \quad \text{(b 1)}$$

in which:

Rf denotes a perfluoroalkyl radical with a linear or branched chain containing at least 6 carbon atoms, k in an integer ranging from 0 to 6 but other than 0 if m is equal to 1

X denotes an oxygen atom or a $CO_2$ or OCO group, m is equal to 0 or 1, n is an integer ranging from 0 to 6, but other than 0 if m and/or p is equal to 1, p is equal to 0 or 1, $M^1$ denotes an anionic hydrophilic monomer unit and $M^2$ a nonionic hydrophilic monomer unit, $q^1$ and $q^2$ are numbers whose sum is between 5 and 100, the ratio $q^2/q^1$ being between 1 and 20, Y denotes a hydrogen atom when p is equal to 1 and an iodine, bromine or chlorine atom when p is equal to 0; and (b) at least one fluorinated surface-active agent an aqueous solution of which at a concentration of 1 g/l has a surface tension at 20° C. which is lower than 25 mN/m;

wherein said foam concentrate does not contain any thixotropic hydrophilic polymer of high molecular weight of the polysaccharide type.

2. Foam concentrate according to claim 1, wherein k=0 or 2, m=n=p=0 and Y is an iodine atom.

3. Foam concentrate according to claims 1, wherein k=2, m=n=0 or 1, p=1 and Y is a hydrogen atom.

4. Foam concentrate according to one of claim 1, wherein the ratio $q^2/q^1$ is between 1 and 10.

5. Method for fighting hydrocarbon fires or polar-liquid fires comprising applying a foam concentrate according to claim 1 to the fire.

6. Foam concentrate according to claim 1, in which the radical Rf contains from 6 to 20 carbon atoms, k is equal to 0 or 2, X denotes an OCO group, n is equal to 0 or 1, the sum $q^1+q^2$ is between 10 and 50, Y is a hydrogen or iodine atom, $M^1$ is a unit of formula:

$$—CH_2—\underset{\underset{COOQ^1}{|}}{CR}— \quad \text{(II)}$$

and $M^2$ a unit of formula:

$$—CH_2—\underset{\underset{Q^2}{|}}{CR'}— \quad \text{(III)}$$

in which each of R and R', which are identical or different, denotes a hydrogen atom or a methyl radical, $Q^1$ denotes a hydrogen atom, an alkali metal ion or a quaternary ammonium ion and $Q^2$ denotes an OH group or a $CONR^1R^2$ group in which each of the symbols $R^1$ and $R^2$, which are identical or different, denotes a hydrogen atom or an alkyl or hydroxyalkyl radical containing from 1 to 3 carbon atoms.

7. Foam concentrate according to claim 6, wherein $Q^1$ is a hydrogen atom and $Q^2$ is an OH or $CONH_2$ group.

8. Foam concentrate according to claim 1, wherein the fluorinated surface-active agent is chosen from the compounds of formulae:

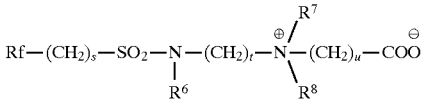

(VII)

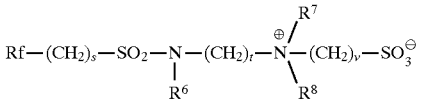

(VIII)

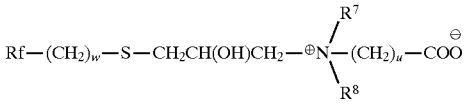

(IX)

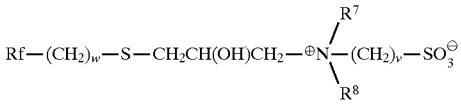

(X)

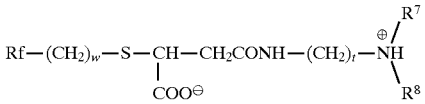

(XI)

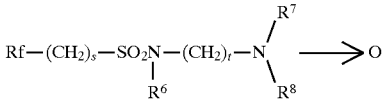

(XII)

$Rf-(CH_2)_w-S-(CH_2)_t-CONH-C(CH_3)_2-CH_2SO_3Na$ (XIII)

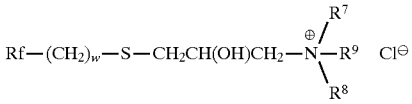

(XIV)

in which Rf denotes a linear or branched perfluoroalkyl radical containing at least 6 carbon atoms, s is an integer ranging from 0 to 6, $R^6$ denotes a hydrogen atom or a methyl or ethyl radical, t and u are integers ranging from 1 to 5, v is equal to 2 or 3, each of the symbols $R^7$, $R^8$ and $R^9$, which are identical or different, denotes a methyl or ethyl radical and w is an integer ranging from 1 to 6.

9. Foam concentrate according to claim 8, wherein the fluorinated surface-active agent is chosen from the compounds of formulae (VII), (VIII), (IX), (X) and (XII) where s=w=2, t=v=3, u=1, $R^7$=$R^8$=methyl and Rf contains from 6 to 20 carbon atoms.

10. Foam concentrate according to claim 9, wherein the fluorinated surface-active agent is chosen from the following compounds:

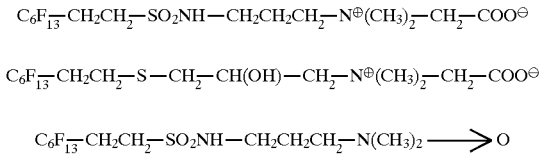

and the mixture of betaines of formula:

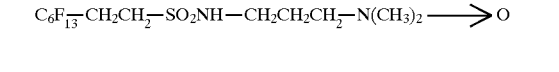

in which x is an even integer ranging from 6 to 20.

11. Foam concentrate according to claim 1, wherein said fluorinated surface-active agent an aqueous solution of which at a concentration of 1 g/l has a surface tension at 20° C. which is lower than 20 mN/m.

12. Foam concentrate according to claim 11, wherein the surface tension is lower than 17 mN/m.

13. Foam concentrate according to claim 1, wherein said fluorinated cotelomer(s) is present in an amount of from 0.1 to 5% by weight; and wherein said fluorinated surface-active agent is present in an amount of from 0.5 to 10% by weight.

14. Foam concentrate according to claims 13, wherein said fluorinated cotelomer(s) is present in an amount of from 0.5 to 2% by weight; and wherein said fluorinated surface-active agent is present in an amount of from 1 to 5% by weight.

15. Foam concentrate according to claims 1, additionally containing a water-miscible organic solvent, an antifreeze, a preserving agent, a pH-stabilizer and/or an anticorrosion agent.

16. Foam concentrate according to claim 15, wherein the water-miscible organic solvent is chosen from glycols or mono- or diethylene (or propylene) glycol monoalkyl ethers.

17. Foam concentrate according to claim 1, stabilized at a pH between 5 and 9.

18. Foam concentrate according to claim 17, stabilized at a pH between 6 and 8.

* * * * *